United States Patent [19]

Gardner

[11] Patent Number: 4,483,444

[45] Date of Patent: Nov. 20, 1984

[54] PACKAGING SYSTEM AND CORNER POST THEREFOR

[75] Inventor: Roland C. Gardner, Doylestown, Pa.

[73] Assignee: Clevepost, Inc., Cincinnati, Ohio

[21] Appl. No.: 459,898

[22] Filed: Jan. 21, 1983

Related U.S. Application Data

[63] Continuation-in-part of Ser. No. 370,793, Apr. 22, 1982.

[51] Int. Cl.[3] ..... B65D 81/02

[52] U.S. Cl. ..... 206/594; 206/320; 206/453; 206/586; 206/591; 206/597

[58] Field of Search ..... 206/320, 453, 586, 587, 206/591, 594, 597, 599, 600

[56] References Cited

U.S. PATENT DOCUMENTS

| | | | |
|---|---|---|---|
| 1,034,567 | 8/1912 | Beadle . | |
| 1,725,592 | 8/1929 | Mertes . | |
| 1,821,692 | 9/1931 | Copeland | 206/586 |
| 1,963,056 | 6/1934 | Wilcox . | |
| 2,277,674 | 3/1942 | Belsinger | 206/586 |
| 2,665,002 | 1/1954 | Baumann et al. | 206/320 |
| 3,244,347 | 4/1966 | Jenk | 206/586 |
| 3,504,848 | 4/1970 | Grafslund | 206/320 |
| 3,648,920 | 3/1972 | Stump | 206/586 |
| 3,653,496 | 4/1972 | Roberts et al. | 206/586 |
| 3,665,818 | 5/1972 | Stump et al. . | |
| 3,665,819 | 5/1972 | Gardner . | |
| 3,736,846 | 6/1973 | Frankenberg . | |
| 3,891,086 | 6/1975 | Isaacs | 206/320 |
| 3,982,682 | 9/1976 | Fremion | 206/320 |
| 4,069,638 | 1/1978 | Hasselqvist et al. . | |
| 4,244,471 | 1/1981 | Plante | 206/586 |
| 4,317,517 | 3/1982 | Tisdale | 206/586 |

FOREIGN PATENT DOCUMENTS

| | | | |
|---|---|---|---|
| 2411141 | 6/1979 | France | 206/586 |

*Primary Examiner*—Joseph Man-Fu Moy
*Assistant Examiner*—David Fidei
*Attorney, Agent, or Firm*—Wood, Herron & Evans

[57] ABSTRACT

A packaging system for an appliance which includes a planar bottom board fastened to the appliance base and dimensioned and configured to provide a horizontal lip which projects outwardly beyond the appliance base perimeter, a container sleeve surrounding the appliance and snugly embracing the bottom board perimeter, and a tubular corner post sandwiched between each vertical corner edge of the appliance and the associated vertical internal corner of the sleeve and overlying and supported by the bottom board lip. To prevent a substantial reduction in the resistance of the corner post to compressive loading applied longitudinally thereto when containerized appliances are stacked, the corner post outer wall is provided, in at least the region adjacent the bottom board, with a vertically disposed indentation or bead. Should the corner post overhang the perimeter of the bottom board, a substantial portion of the post cross-section remains within the bottom board perimeter supported by the lip, thereby distributing compressive loads applied longitudinally to the corner post over substantially the entire cross-section thereof, in turn preventing a substantial reduction in resistance of the post to buckling.

9 Claims, 8 Drawing Figures

PACKAGING SYSTEM AND CORNER POST THEREFOR

Figures 1, 1A:
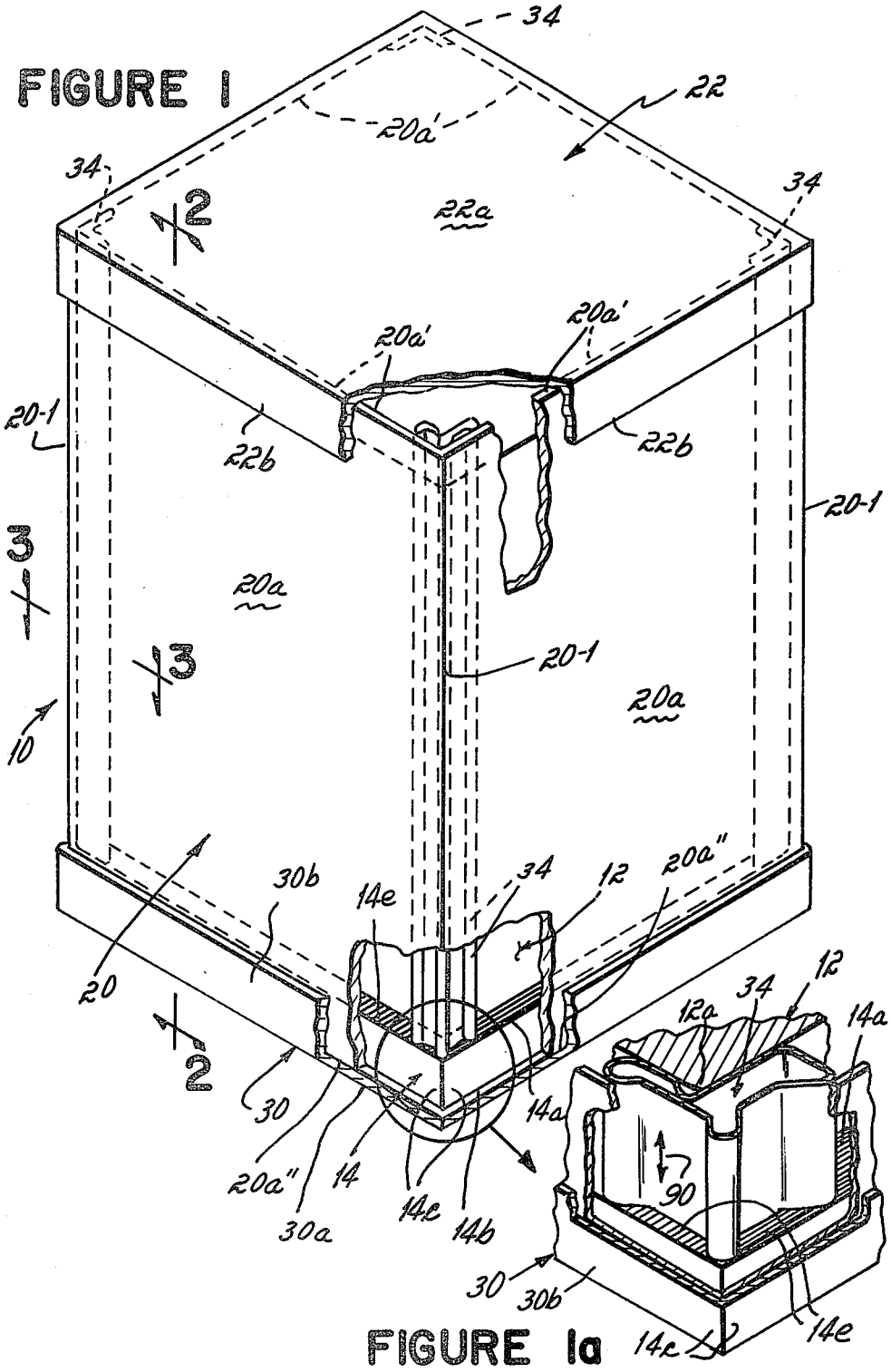

This is a continuation-in-part of Ser. No. 370,793 filed Apr. 22, 1982 entitled IMPROVED SUPPORT AND CUSHIONING TUBE.

This invention relates to packaging for heavy products such as clothes washers and dryers, refrigerators, stoves, and the like, and more particularly to an improved packaging system and corner post therefor which accommodates overhang of a portion of the corner post relative to a bottom board to which the base of the appliance is mounted without a substantial reduction in the resistance of the corner post to compressive loads.

By way of background, for some time it has been the practice in the appliance industry to fasten the base of an appliance to a rectangular bottom board, such as one-half inch thick plywood platform, for the purpose of facilitating convenient transport of the appliance during its manufacture and assembly. Typically, the bottom board is dimensioned and configured to be oversized relative to the appliance base such that a horizontal lip is provided which extends outwardly beyond the perimeter of the applicance base. After the appliance has been completely manufactured and assembled, a protective shipping sleeve, such as corrugated cardboard, is placed around the appliance and the base. The sleeve is dimensioned and configured to snugly embrace the perimeter of the bottom board.

Since the perimeter of the bottom board exceeds the perimeter of the appliance by reason of the lip provided on the base board which extends horizontally beyond the base of the appliance, a clearance exists overlying the lip between the front, rear, and side walls of the appliance and the confronting interior surfaces of the front, rear, and side walls of the corrugated sleeve. To strengthen the container sleeve with respect to compressive forces which are applied when containerized appliances are stacked one above the other, it has been proposed to place corner posts at each corner of the containerized appliance overlying the bottom board lip and sandwiched between the external vertical corner edge of the appliance and the internal corner of the sleeve. Compressive loads applied to a containerized appliance as the result of stacking or the like are, ideally, transmitted to the corner post over its entire horizontal cross section. For example, if the corner post is a convolutely wound, flattened, resin-treated tube, the load is distributed, ideally, over the entire inner and outer walls of the post which cooperate to define its generally flattened tubular cross section.

Unfortunately, and due to a variety of reasons, corner posts may have a portion of their outer wall overhang, that is, extend horizontally beyond, the perimeter of the bottom board such that the entire horizontal cross section of the corner post is not supported by the lip of the bottom board. When this occurs, compressive loads applied longitudinally to the post as a consequence of containerized appliance stacking or the like, are not applied to the entire cross section of the post, but rather only to the inner wall of the tubular post. As a result, substantially less than the entire cross section carries the load, causing a very substantial reduction in the resistance of the post to longitudinally-applied compressive forces applied to the post. When this occurs, the post buckles prematurely, resulting in damage to the containerized appliance.

The condition of overhang of the outer wall of a tubular post with respect to the bottom board lip can be caused by inadequately sized bottom board lips which can result when an appliance shifts laterally relative to a properly sized bottom board, or by an undersized bottom board. Post overhang can occur even with an appliance properly located on a correctly sized bottom board, should the protective sleeve be oversized relative to the perimeter of the bottom board such that the clearance between the interior of the sleeve and the appliance walls exceeds the overall external thickness of the tubular post, measured horizontally, allowing the tubular post to shift outwardly and its outer wall overhang the perimeter of the bottom board.

Accordingly, it has been an objective of this invention to provide a packaging system for an appliance or the like which accommodates overhang of a tubular corner post relative to a bottom board without substantially reducing the resistance of the corner post to compressive forces and in turn producing premature buckling of the corner post and consequent damage to the appliance. This objective has been accomplished in accordance with the principles of this invention by providing the outer wall of the tubular corner post, throughout its entire length, with longitudinally extending indentations or beads which extend horizontally over a substantial perimetric portion of the outer post wall, preferably over at least fifty percent thereof. As a consequence of indenting or beading the outer wall of the corner post, should an overhang condition exist between the corner post and the perimeter of the bottom board, the indented portion of the exterior wall of the corner post, providing the overhang does not exceed the depth of the indentation, is still located within the perimeter of the bottom board overlying and supported by the bottom board lip. Accordingly, compressive loads applied longitudinally to the overhanging corner post are distributed over substantially, although not 100% of, the entire cross section of the corner post, with the result that the resistance of the corner post to compressive loading, and in turn its resistance to premature buckling, is not substantially reduced by reason of the overhang condition.

A further advantage of the invention, also attributable in part to the indentation in the outer wall thereof, is that it divides the angulated hollow tubular post into plural longitudinally-extending tubular subsections which are effectively interconnected by webs defined by the indented portions of the outer wall and the confronting portions of the inner wall. The multiple tubular subsections which are interconnected by the webs cooperate to further enhance the resistance of the hollow tubular corner post to compressive forces.

Figure 2:
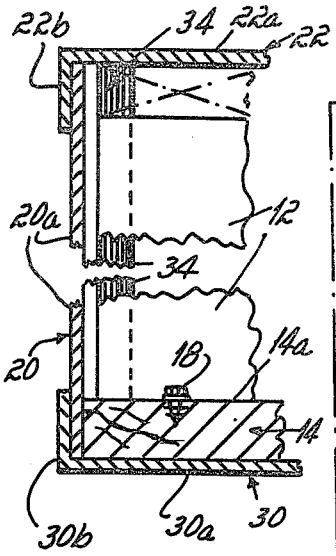
Figure 3:
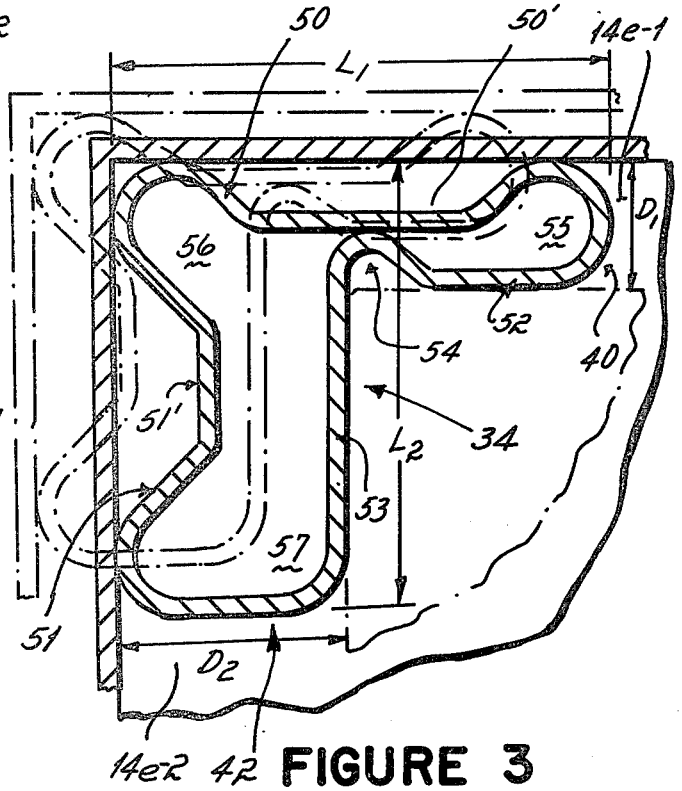
Figure 3A:
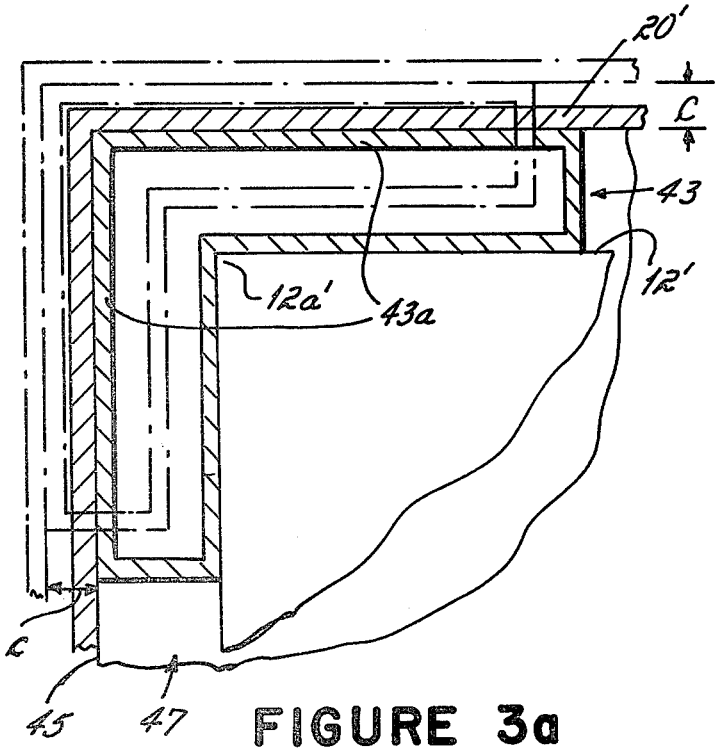
Figure 4:
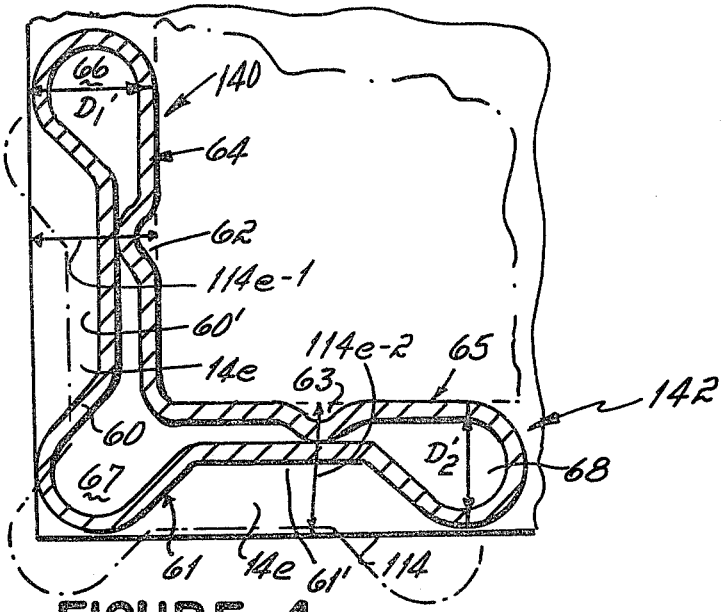
Figure 5:
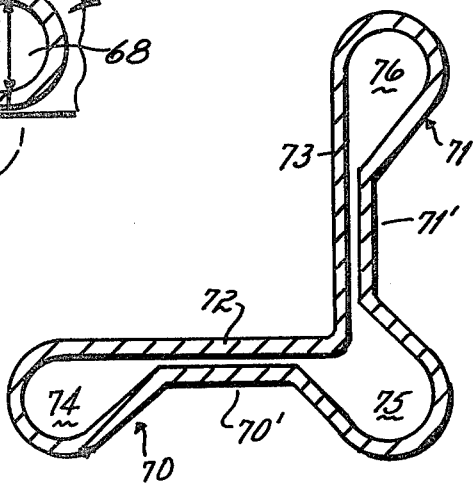
Figure 6:
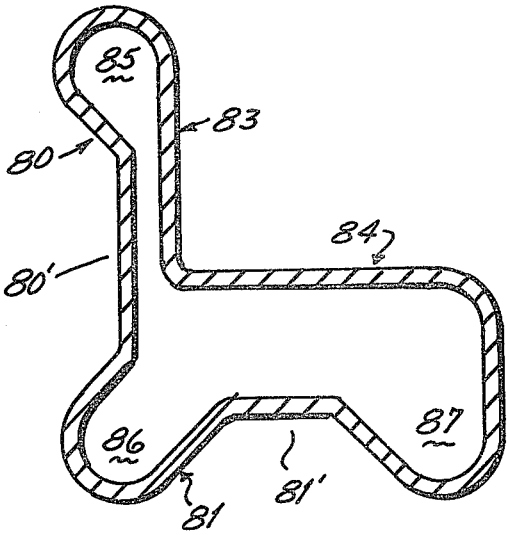

These and other advantages, objectives, and features of the invention will be more readily apparent from a detailed description of the drawings in which:

FIG. 1 is a perspective view of an appliance secured to a bottom board which is located within a container having a tubular corner-reinforcing post constructed in accordance with one embodiment of this invention, FIG. 1*a* is an enlarged view of the encircled portion of FIG. 1, FIG. 2 is a cross sectional view along line 2—2 of FIG. 1, and FIG. 3 is a cross sectional view along line 3—3 of FIG. 1, FIG. 3*a* is a cross sectional view similar to FIG. 3, showing a corner post which is not constructed in accordance with the principles of this invention, FIGS. 4, 5, and 6 are horizontal cross sectional views of further embodiments of the tubular corner-reinforcing post constructed in accordance with the principles of this invention.

To facilitate a more complete understanding of the invention, the preferred embodiments thereof are shown, by way of example, in conjunction with a container 10 for an appliance 12 secured to a bottom board 14 which is located therein for shipping and storage purposes, as seen best in FIGS. 1, 1*a*, 2, and 3. The appliance 12, which may be a clothes washing machine, clothes dryer, refrigerator, dishwasher, or the like, typically has an overall shape or envelope which is in the form of a rectangular parallelpiped with four vertical edges 12*a* which are located at the corners of a rectangle. Secured to the bottom or base of the appliance 12 by fasteners 18 is the bottom board 14 which takes the form of a wooden platform made of plywood or the like. In practice, the appliance framework is fastened to the upper surface 14*a* of the bottom board 14 at the commencement of the appliance manufacturing and assembly operation to facilitate convenient transport of the appliance to different work stations during various phases of its manufacture. The bottom board 14, in addition to upper and lower surfaces 14*a* and 14*b*, has a perimeter 14*c* defined by four vertical side faces.

The container 10, which is preferably fabricated of corrugated fiberboard or the like, includes a tubular sleeve 20 consisting of four rectangular sides 20*a* which are interconnected at corners 20-1. The upper end of the sleeve 20 defined by the upper edge 20*a*′, which is otherwise open, is adapted to be sealed by an upper end cap 22 having a horizontal top panel 22*a* from which extends downwardly around the entire perimeter of the panel 22*a* a lip or flange 22*b* which snugly embraces the upper exterior surface of the sleeve 20. The lower end of the sleeve 20 defined by the lower edge 20*a*″ is also open, but adapted to be sealed by a lower end cap 30 having a horizontal rectangular panel 30*a* from which extends in an upwardly direction around the entire perimeter thereof a lip or flange 30*b* which snugly embraces the lower exterior surface of the sleeve 20.

Located within the sleeve 20 and resting on the upper surface of the lower cap panel 30*a* is the bottom board 14 which is designed to have its entire perimeter 14*c* snugly embraced by the inner surface of the sleeve 20. Extending upwardly from the bottom board 14 and filling substantially the entire volume of the sleeve 20 is the appliance 12. Located in each corner of the sleeve 20 between the interior surface thereof and the respective appliance corner edges 12*a* are tubular corner-reinforcing posts 34 of identical construction. The upper extremity of each post 34 is designed to be in contact with the lower surface of the panel 22*a* of the upper cap 22. The lower extremity of each post 34 rests on the upper surface 14*b* of the bottom board interiorly of the perimeter 14*c*.

The perimeter 14*c* of the bottom board 14 is dimensioned and configured such that it provides a lip 14*e* extending horizontally outboard of the perimeter of the base of appliance 12 a distance just sufficient to fully support the entirety of the corner post. If the overall thickness D1 and D2 of the angulated corner post sections 40 and 42 of a corner post, such as the corner post 34 shown in FIG. 3, are unequal, the width (measured in a horizontal direction) of the bottom board lip section 14*e*-1 underlying corner post section 40 will be different than that of the lip section 14*e*-2 underlying corner post section 42, as is apparent from FIG. 3. Alternatively, if the overall dimensions D1′ and D2′ of the angulated wall sections 140 and 142 of the corner post are equal, such as shown in FIG. 4, the width of the lip sections 114*e*-1 and 114*e*-2 of the bottom board 114 are equal and substantially coextensive with the width D1′ and D2′ of the corner post wall sections 140 and 142, as shown in FIG. 4.

By dimensioning the width of lip sections 14*e*-1 and 14*e*-2 of post 34 to equal the overall thickness D1 and D2 of the wall panel sections 40 and 42, and by dimensioning the perimeter of the sleeve 20 to snugly embrace the perimeter 14*c* of the bottom board 14, all as described hereinabove in connection with FIGS. 1–3, the corner posts 34 are snugly sandwiched between the outer corners 12*a* of the appliance 12 and the inner corners of the sleeve, with the entire cross section of each corner post supported on the underlying lip 14*e* of the bottom board. As a consequence, when appliances 12 boxed in containers 10 are stacked one above the other, such as in a warehouse or during shipping, the entire horizontal cross section of each corner post 34 resists longitudinal compression forces in a vertical direction attributable to the stacking of the containers one on top of the other.

Occasionally, the entire horizontal cross section of the corner post is not overlying and fully supported by the lip 14*e* of the bottom board, such as when a corner post 43 configured as shown in FIG. 3*a*, is in the phantom line position shown in FIG. 3*a*. When this occurs, compressive loads applied longitudinally to the corner post 43 in a vertical direction when containers are stacked are not distributed over the entire horizontal cross section of the corner post. For example, when the post 43 is in the phantom line position shown in FIG. 3*a*, the outer wall 43*a* thereof overhangs the perimeter 45 of the bottom board 47. As a consequence of this overhang condition, the outer post wall 43*a* bears no substantial portion of the compressive load applied longitudinally to the corner post, with the result that the corner post can prematurely buckle under the compressive loading, resulting in damage to the appliance stored in the container.

Lateral overhang of the outer wall of a corner post relative to the perimeter of an underlying bottom board can be caused by a number of a factors. For example, the appliance can be improperly positioned on the bottom board such that the width of one or more of the lips of the bottom board is less than the overall thickness of the angled corner post sections. Such a condition can also be caused by a bottom board which is too small relative to the appliance, as a consequence of which the bottom board lips are insufficient in width to support the entire cross section of the corner post. Alternatively, and notwithstanding a properly dimensioned bottom board which supports a correctly positioned appliance, one or more walls of the container sleeve may be too large relative to the perimeter of the properly dimensioned bottom board, with the result that a clearance C, as shown in FIG. 3*a*, exists between the interior surface of the sleeve walls 20′ and the perimeter 45 of the bottom board 47, which in turn permits the corner post to move laterally outwardly and away from the corner 12*a*′ of the appliance 12′ to, for example, the phantom line position shown in FIG. 3*a*, in which event the outer wall 43*a* of the corner post 43 overhangs the perimeter 45 of the bottom board 47. Regardless of the cause of the corner post overhanging the perimeter of the bottom board, the result is the same, namely, the corner post does not support throughout its entire horizontal cross section compressive loads applied to it in a longitudinal direction, which in turn results in premature buckling of the post and damage to the appliance.

The corner post of this invention, of which various embodiments are depicted in FIGS. 3, 4, 5, and 6, obviates the premature buckling problem which occurs when corner posts overhang the perimeter of the bottom board as discussed in connection with FIG. 3*a*. More particularly, the aforedescribed problem is overcome by longitudinally beading or indenting the corner post throughout a substantial perimetric portion of its outer wall. For example, in the embodiment shown in FIG. 3, the outer wall sections 50 and 51 of the corner post 34 are provided with indentations or beads 50' and 51', respectively, extending in a horizontal direction over a substantial perimetric portion of the total length L1 and L2 of the outer corner wall sections 50 and 51. Indentations or beads 50' and 51' extend vertically the entire length of the post.

As a consequence of the indentations 50' and 51' in the outer wall sections 50 and 51 of the corner post 34 shown in FIG. 3, should the corner post shift from the solid line position fully supported by the underlying lips 14*e*-1 and 14*e*-2 to the phantom line position overhanging the perimeter 14*e* of the lip, the indented portions 50' and 51' of the exterior walls 50 and 51 remain inboard of the underlying perimeter 14*e* of the lip and fully supported thereby. As a consequence, with this invention, compressive loads applied longitudinally to a corner post overhanging the periphery of its associated bottom board, are distributed over substantially, although not over one hundred percent of, the entire cross section of the post. Therefore, and notwithstanding that the corner post of this invention overhangs the bottom board periphery, the resistance of the corner post to compressive forces which tend to induce buckling is not substantially reduced.

The interior wall 52 of the corner post 34 of FIG. 3 in the region where it joins the interior wall section 53 thereof is indented or beaded at 54 along the entire length of the post to further enhance the resistance of the post to buckling-inducing compressive forces. By reason of the indentations or beads 50, 51, and 54, the corner post, which is generally in the form of a flattened tube, is divided into a plurality of generally longitudinally-directed tubular subsections 55, 56, and 57 which are either fully enclosed, such as at 55, or substantially fully enclosed, such as at 56 and 57. The tubular subsections 55, 56, and 57 are interconnected by the indented portions 50' and 51' of the angled post walls 50 and 51 and confronting portions of walls 52 and 53, which effectively define longitudinal webs interconnecting the generally tubular subsections 55, 56, and 57.

A further embodiment of the invention, depicted in FIG. 4, includes outer walls 60 and 61 which are provided with indented sections 60' and 61', respectively. Beads or indentations 62 and 63 formed in angled inner walls 64 and 65 have their interior surfaces located proximate, and preferably in contact with, the confronting inner surfaces of the indented portions 60' and 61' of the outer walls 60 and 61. Cooperating indentations 60' and 62, and cooperating indentations 61' and 63, collectively divide the corner post into three closed longitudinally-directed tubular subsections 66, 67, and 68. Tubular subsections 66 and 67 are interconnected by web-defining indentations or beads 60' and 62', while tubular subsections 67, 68 are interconnected by web-defining beads or indentations 61' and 63. The beads or indentations 60' and 61', for the same reasons described in connection with the indentations 50' and 51' (FIG. 3), enable longitudinal compressive loads applied to the post depicted in FIG. 4 to be distributed over substantially the entire horizontal cross section of the post notwithstanding that a portion of the outer wall of the post overhangs the perimeter 14*e* of the bottom board 14 such as would occur were the post in the phantom line position depicted in FIG. 4. Additionally, the three tubular subsections 66, 67, and 68 in combination with the cooperating interconnecting webs further enhance the resistance of the post to longitudinal compressive loads.

In the embodiment of FIG. 5, the corner post is provided with outer walls 70 and 71 which are provided with beads or indentations 70' and 71' which extend longitudinally throughout the entire length of the corner post. The proximity of the inner surfaces of the indentations 70' and 71' to the confronting inner surfaces of the inner wall sections 72 and 73 effectively divides the corner post depicted in FIG. 5 into three longitudinally-directed tubular subsections 74, 75, and 76 which are interconnected by webs defined by the proximately located portions of walls 70' and 72 and the proximately located portions of walls 71' and 73. The tubular subsections 74, 75, and 76 in combination with the interconnecting webs further enhance the resistance of the post to compressive forces applied in a longitudinal direction.

A further embodiment of a corner post incorporating the principles of this invention is depicted in FIG. 6. In accordance with this embodiment, outer wall sections 80 and 81 are provided with longitudinally indented or beaded portions 80' and 81'. Should the corner post depicted in FIG. 6 shift laterally outwardly relative to the perimeter 14*e* of a bottom board 14 on which it is resting, the beaded or indented portions 80' and 81' of the outer wall sections 80 and 81 will remain inwardly of the bottom board perimeter supported by the lip thereof. As a consequence, compressive loads applied in a longitudinal direction to the corner post will be distributed over substantially the entire horizontal cross section of the corner post, preventing any substantial reduction in resistance of the post to buckling should overhand occur. In the corner post embodiment depicted in FIG. 6, the rear wall sections 83 and 84 are not provided with indentations or beads. Nevertheless, the overall cross sectional configuration of the corner post is roughly divided into three longitudinally-directed tubular subsections 85, 86, and 87 which collectively cooperate to further enhance the overall resistance of the post to buckling due to compressive forces applied longitudinally thereto.

The corner posts are preferably fabricated of convolutely wound fiber-containing sheet material, preferably Kraft paper, in which the fibers extend predominantly longitudinally in the direction of double headed arrow 90 (FIG. 1*a*), with adjacent convolutions bonded together with a hardenable adhesive or bonding material. The method of forming the post to the desired shape can be accomplished in accordance with the disclosure of co-pending application Ser. No. 370,793, filed Apr. 22, 1982, in the name of Roland C. Gardner, assigned to Clevepost, Inc., the entire disclosure of which is incorporated herein by reference.

While the invention has been described in connection with corner posts which each have a pair of angled sections to engage the associated vertical corner edge of an appliance, the invention is also applicable to posts which are not angled. Such non-angled posts could be vertically disposed in the clearance space between the sleeve and appliance walls overlying the bottom board lip at a point intermediate adjacent corners, such as midway between adjacent pairs of corners. Located as such, the inner flat wall of the post would contact the appliance wall at a point midway between its corners 12*a* while the outer flat wall of the post would contact the inner surface of the associated sleeve wall 20*a*. The longitudinally-directed bead or indentation in the outer post wall would function to accommodate post overhang in the same manner as, for example, beads or indentations 50' and 51' do in the corner post 34.

What is claimed is:

1. A packaging system for a product to be protected against vertically directed compressive forces, comprising:

a rigid platform having four corners defining a first rectangle with a perimeter of predetermined dimensions, said platform having an upper surface immovably mounted relative to the base of a product to be packaged, said platform having a horizontal cross section larger than that of said product base to define a platform lip outwardly of said product base, a container having horizontal superimposed rectangular top and bottom panels between which are positioned interconnecting vertical side walls defining four interior corners, the interior surfaces of said side walls defining a second rectangle proximate said first rectangle defined by said platform corners when said product is positioned in said container with said platform overlying said bottom panel, at least one of said vertical side walls being locatable outwardly relative to said platform perimeter to provide a gap therebetween, a hollow corner post located proximate each interior corner of said container extending vertically between a plane containing said upper surface of said platform and a plane containing said top panel, each said post having a lower end region adjacent said platform which is provided with (a) an outer vertical wall including a first vertical post wall section locatable adjacent said interior surface of said container side walls in the region of its respectively associated interior corner, and a second vertical post wall section inwardly spaced from said first vertical post wall section and in noncontacting relation to said interior surface of said container side walls when said first vertical post wall section is in contact with said interior surface of said container side walls, said second post wall section constituting a substantial fractional portion of said outer wall, and (b) an inner vertical post wall spaced from and rigidly connected to said outer post wall and locatable adjacent the respectively associated vertical corner of said product when said product is located on said platform within said container overlying said bottom panel, said inner post wall and said first and second post wall sections of said outer wall of said corner posts each being locatable to overlie said platform lip within said predetermined platform perimeter when said platform lip is at least equal to the overall thickness of said post defined by said spaced inner and outer vertical walls to distribute compressive forces applied to said posts via said top and bottom panels over the entire cross section of said posts, said inner post wall and said second post wall section of said outer post wall being locatable to overlie said platform lip within said predetermined platform perimeter when said platform perimeter is located between vertical planes containing said first and second sections of said outer post wall to distribute compressive forces applied to said post via said top and bottom panels over both said second section of said outer post wall and said inner post wall, whereby the resistance of each said post to compressive forces is not substantially reduced when said first section of said outer post wall extends outwardly beyond said predetermined rectangular perimeter defined by said platform corners to overhang said platform perimeter above said gap unsupported by said platform lip.

2. The system of claim 1 wherein said corner post includes an elongated flattened tube fabricated of convolutely wound fiber-containing sheet material in which the fiber direction is predominantly longitudinal and the convolutions are bonded together with a hardenable bonding material, and wherein said second section of said outer wall is included in a first vertical, longitudinally-directed indentation extending substantially the entire length of the tube.

3. The system of claim 2 wherein said inner wall of said tube includes a second vertical, longitudinally-directed indentation having an inner surface proximate and adapted to contact the inner surface of said outer wall when said corner begins to buckle under compressive forces applied thereto.

4. The system of claim 3 wherein said first and second indentations are aligned with each other.

5. The system of claim 2 wherein said first indentation divides said flattened tube into plural longitudinally-directed subsections interconnected by web-defining portions of said inner and outer post walls located between said tubular subsections.

6. A packaging system for an appliance or the like, comprising:

a planar bottom board fastenable to the base of the appliance and dimensioned and configured relative thereto to provide a horizontal lip which projects outwardly beyond the perimeter of an appliance base, a container sleeve surrounding the perimeter of the bottom board and locatable outwardly relative thereto to provide a gap between the bottom board perimeter and the interior of the container sleeve, and at least one vertically disposed tubular post sandwiched between each appliance wall and the associated sleeve wall and overlying and supported by the lip of the bottom board, said post having a lower end region adjacent said bottom board which is provided with (a) an outer wall section disposed proximate the sleeve and (b) an inner wall section disposed proximate the appliance wall, said outer wall section having throughout substantially its entire length, a vertically disposed indentation which extends horizontally over a substantial circumferential portion of said outer wall section, said indentation leaving a remaining fractional zone of said outer wall section, said indentation in said outer wall section overlying and being supported by said bottom board lip when said remaining fractional zone of said outer wall section overhangs said bottom board perimeter above said gap unsupported by said bottom board lip.

7. The system of claim 6 wherein said post is a corner post having a pair of angled tubular sections to enable said inner tube wall thereof to snugly embrace an associated outer vertical corner of an appliance, and wherein said vertically disposed indentation is provided in each said angled tubular section along substantially the entire length thereof, effectively dividing said tubular corner post throughout substantially its entire length into at least three longitudinally-directed tubular subsections to enhance the resistance of said tubular corner post to compressive forces.

8. The system of claim 7 wherein said inner wall of each said angled tube section includes a vertical, longitudinally-directed indentation having an inner surface proximate and adapted to contact the inner surface of said outer wall when said corner begins to buckle under compressive forces applied thereto.

9. The system of claim 8 wherein said indentations in said inner and outer walls are aligned with each other.

* * * * *